US010625314B2

(12) United States Patent
Hashimoto

(10) Patent No.: US 10,625,314 B2
(45) Date of Patent: Apr. 21, 2020

(54) CLEANING WATER FEEDING TOOL, WATER SPRINKLING CLEANING APPARATUS, AND METHOD FOR CLEANING PAINT COLLECTING PATH

(71) Applicant: TRINITY INDUSTRIAL CORPORATION, Toyota-shi, Aichi (JP)

(72) Inventor: Takashi Hashimoto, Nagoya (JP)

(73) Assignee: TRINITY INDUSTRIAL CORPORATION, Toyoda-shi (JP)

( * ) Notice: Subject to any disclaimer, the term of this patent is extended or adjusted under 35 U.S.C. 154(b) by 386 days.

(21) Appl. No.: 15/422,143

(22) Filed: Feb. 1, 2017

(65) Prior Publication Data

US 2017/0282226 A1 Oct. 5, 2017

(30) Foreign Application Priority Data

Mar. 30, 2016 (JP) ..... 2016-068551

(51) Int. Cl.
*B08B 9/093* (2006.01)
*B05B 3/06* (2006.01)
*B05B 14/468* (2018.01)

(52) U.S. Cl.
CPC ..... *B08B 9/0936* (2013.01); *B05B 3/066* (2013.01); *B05B 14/468* (2018.02)

(58) Field of Classification Search
CPC . B08B 9/0936; B05B 14/468; B05B 15/1225; B05B 3/066
See application file for complete search history.

(56) References Cited

U.S. PATENT DOCUMENTS 3,599,871 A * 8/1971 Ruppel ..... B08B 9/0936 239/227
5,135,550 A 8/1992 Telchuk et al.
(Continued)

FOREIGN PATENT DOCUMENTS

CN 203667292 U 6/2014
CN 103920685 A 7/2014
(Continued)

OTHER PUBLICATIONS

Jul. 24, 2019 Office Action issued in Chinese Patent Applicaion No. 201710101385.4.
(Continued)

*Primary Examiner* — Douglas Lee
(74) *Attorney, Agent, or Firm* — Oliff PLC

(57) ABSTRACT

A cleaning water feeding tool having a pipe structure to feed cleaning water to a water sprinkling cleaning device which has both end portions rotatably supported by a rotary base laid between a pair of rotary support parts disposed opposite to each other on a basket-shaped base, and includes the rotary head rotates with respect to the rotary base, and the rotary base rotates with respect to the basket-shaped base, including a horizontal portion that has a tip end portion connected to the cleaning water supply port and extends approximately horizontally in a state where a rotary shaft of the rotary base is disposed approximately horizontally, a straight portion that extends upward from the horizontal portion; and a hard material that configures or covers at least a portion receiving the cleaning water jetted from the water jet part of the straight portion.

8 Claims, 5 Drawing Sheets

(56) References Cited

U.S. PATENT DOCUMENTS

| | | | | |
|---|---|---|---|---|
| 5,286,268 | A | 2/1994 | Watanabe | |
| 6,021,793 | A * | 2/2000 | Moulder | B05B 3/02 134/167 R |
| 8,814,061 | B1 * | 8/2014 | Delaney | B05B 3/0445 239/227 |
| 2004/0027913 | A1 * | 2/2004 | Cockbain | B01F 3/0857 366/169.2 |
| 2018/0236507 | A1 * | 8/2018 | Vargas Junior | B08B 9/0933 |

FOREIGN PATENT DOCUMENTS

| | | | |
|---|---|---|---|
| CN | 204171052 | U | 2/2015 |
| CN | 204912223 | U | 12/2015 |
| JP | S55-033949 | B2 | 9/1980 |
| JP | H05-060553 | U | 8/1993 |
| JP | H06-099155 | A | 4/1994 |
| JP | H10-339502 | A | 12/1998 |
| JP | 2000-140872 | A | 5/2000 |
| JP | 2006-348683 | A | 12/2006 |
| JP | 3143501 | U | 7/2008 |
| JP | 2014-036943 | A | 2/2014 |

OTHER PUBLICATIONS

Jan. 21, 2020 Office Action issued in Japanese Patent Application No. 2016-068551.

* cited by examiner

CLEANING WATER FEEDING TOOL, WATER SPRINKLING CLEANING APPARATUS, AND METHOD FOR CLEANING PAINT COLLECTING PATH

TECHNICAL FIELD

The present invention relates to a cleaning water feeding tool to feed cleaning water to a water sprinkling cleaning device capable of jetting cleaning water in approximately all three-dimensional directions, a water sprinkling cleaning apparatus including the cleaning water feeding tool and the water sprinkling cleaning device, and a method for cleaning a paint collecting path using the water sprinkling cleaning apparatus.

DESCRIPTION OF THE RELATED ART

Generally, it is known that under a floor of a paint booth, a paint collecting path is provided which is covered at its upper side with an upper surface wall, and into which uncoated paint is taken together with air from a plurality of through holes formed in the upper surface wall (for example, refer to Patent Literature 1).

CITATION LIST

Patent Literature

[Patent Literature 1] Japanese Unexamined Patent Application Publication No. 2014-36943 (FIG. 1)

SUMMARY OF THE INVENTION

Problems to be Solved by the Invention

However, there is a conventional problem that for example, a worker is forced to perform a difficult work of entering the inside of a paint collecting path called a booth under section and performing cleaning in order to clean the inside.

The present invention has been made in view of the above-described circumstances, and it is an object of the present invention to provide a cleaning water feeding tool, a water sprinkling cleaning apparatus, and a method for cleaning a paint collecting path that enable easy cleaning of a paint collecting path.

Means of Solving the Problems

A cleaning water feeding tool according to the present invention made to attain the above-described object is a cleaning water feeding tool to feed cleaning water to a water sprinkling cleaning device which has both end portions rotatably supported by a rotary base laid between a pair of rotary support parts disposed opposite to each other on a basket-shaped base, and includes a water jet part provided at a side portion of a rotary head that projects from one side surface of the rotary base and is rotatably supported, and is constituted so that, when cleaning water is supplied from a cleaning water supply port provided on one of the rotary support parts to the rotary base, cleaning water jets from the water jet part, the rotary head rotates with respect to the rotary base, and the rotary base rotates with respect to the basket-shaped base, wherein the cleaning water feeding tool has a pipe structure formed so that the cleaning water feeding tool has a tip end portion connected to the cleaning water supply port, and is bent halfway so as to extend upward in a state that a rotary shaft of the rotary base is disposed approximately horizontally, and at least a portion to receive cleaning water jetted from the water jet part is made of a hard material or covered with a hard material.

DESCRIPTION OF THE EMBODIMENTS

First Embodiment

Figure 1:
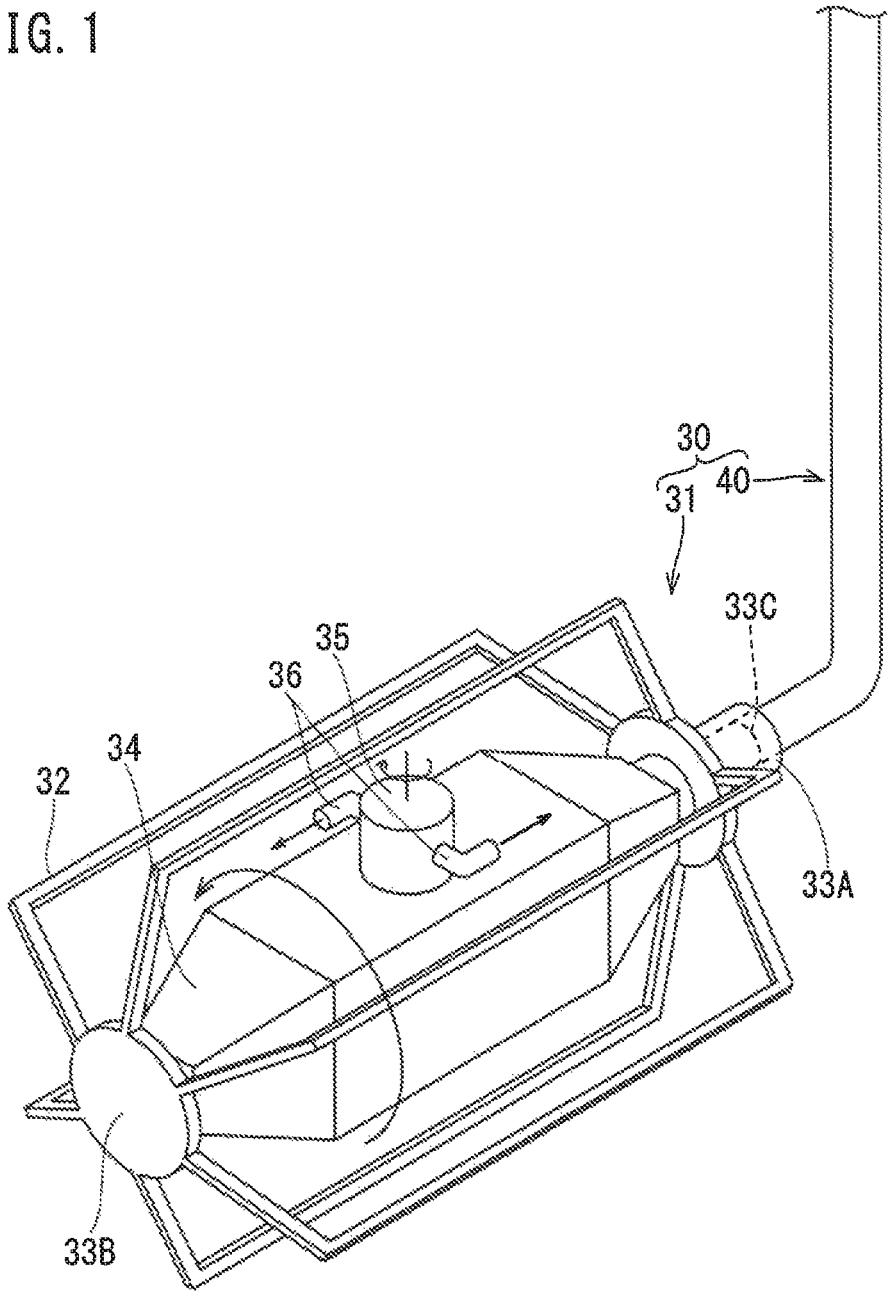
FIG. 1 is a perspective view of a water sprinkling cleaning apparatus according to a first embodiment of the present invention.

Hereinafter, a first embodiment of the present invention is described with reference to FIG. 1 to FIG. 3. FIG. 1 shows a water sprinkling cleaning apparatus 30 according to the present invention. This water sprinkling cleaning apparatus 30 includes a water sprinkling cleaning device 31 and a cleaning water feeding tool 40. The water sprinkling cleaning device 31 is structured in a state that a rotary base 34 is rotatably supported between a pair of rotary support parts 33A and 33B disposed opposite to each other on a basket-shaped base 32, and a rotary head 35 is projected from one side surface of the rotary base 34 and supported rotatably with respect to the rotary base 34. On a side portion of the rotary head 35, a pair of water jet parts 36 and 36 are provided point-symmetrically, and each water jet part 36 projects laterally from the rotary head 35 and has a tip end portion bent at a right angle so that a tip end opening is directed in a circumferential velocity direction of rotation of the rotary head 35. Inside the rotary base 34, a first gear (not shown) that rotates integrally with the rotary head 35 and a second gear that is attached to a shaft (not shown) fixed to one rotary support part 33B of the basket-shaped base 32 engage with each other. When cleaning water at a high pressure is then supplied to a cleaning water supply port 33C provided in the other rotary support part 33A, by jetting cleaning water from the water jet parts 36, the rotary head 35 rotates in one direction with respect to the rotary base 34 and the first gear rolls along the second gear, and the rotary base 34 rotates in one direction with respect to the basket-shaped base 32. Accordingly, the cleaning water is sprinkled in all three-dimensional directions.

Figure 2:
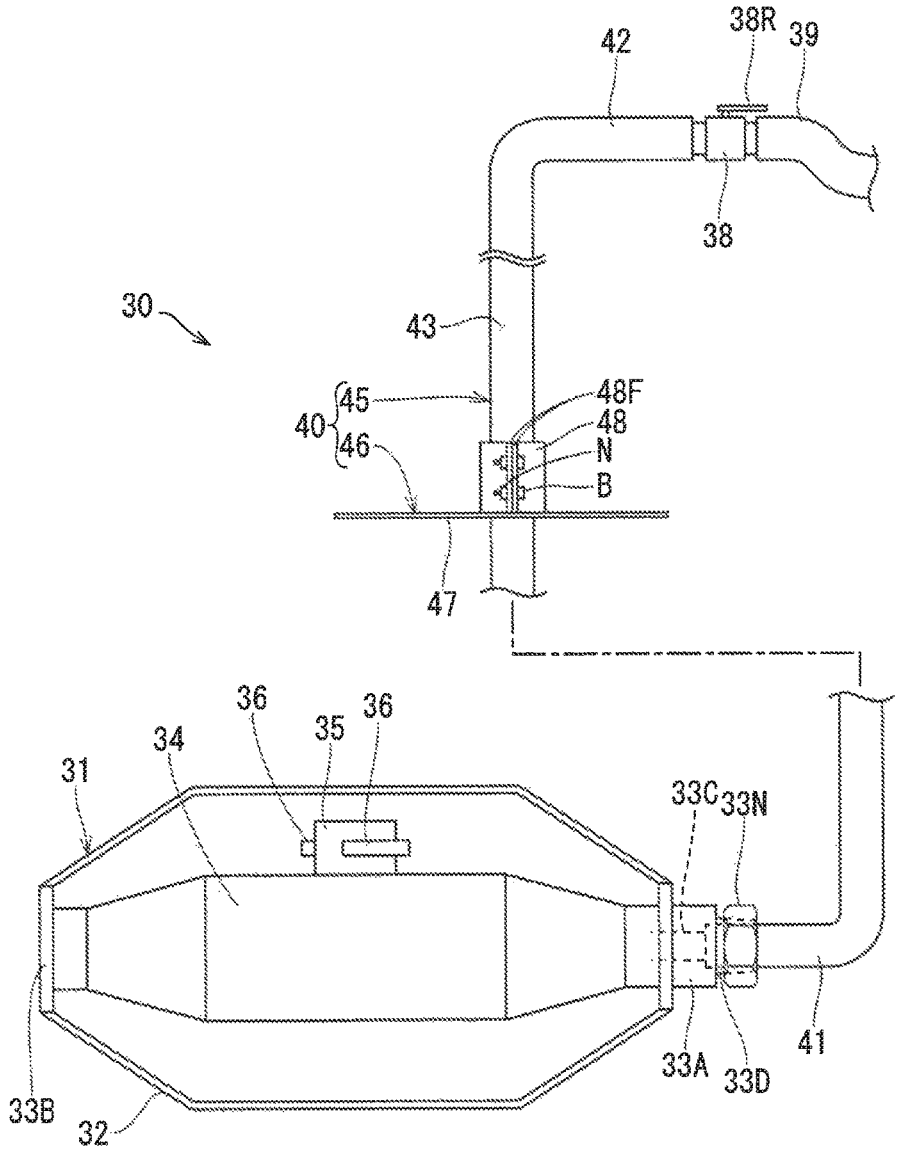
FIG. 2 is a side view of the water sprinkling cleaning apparatus.

As shown in FIG. 2, the rotary support part 33A on the side having the cleaning water supply port 33C is provided with a coupling cylinder part 33D having tapered threads on an outer surface. A plurality of slits (not shown) extending from a tip end to a position close to a base end are formed in this coupling cylinder part 33D. Then, the coupling cylinder part 33D is narrowed by tightening a tapered nut 33N onto the outside of the coupling cylinder part 33D.

Figure 3:
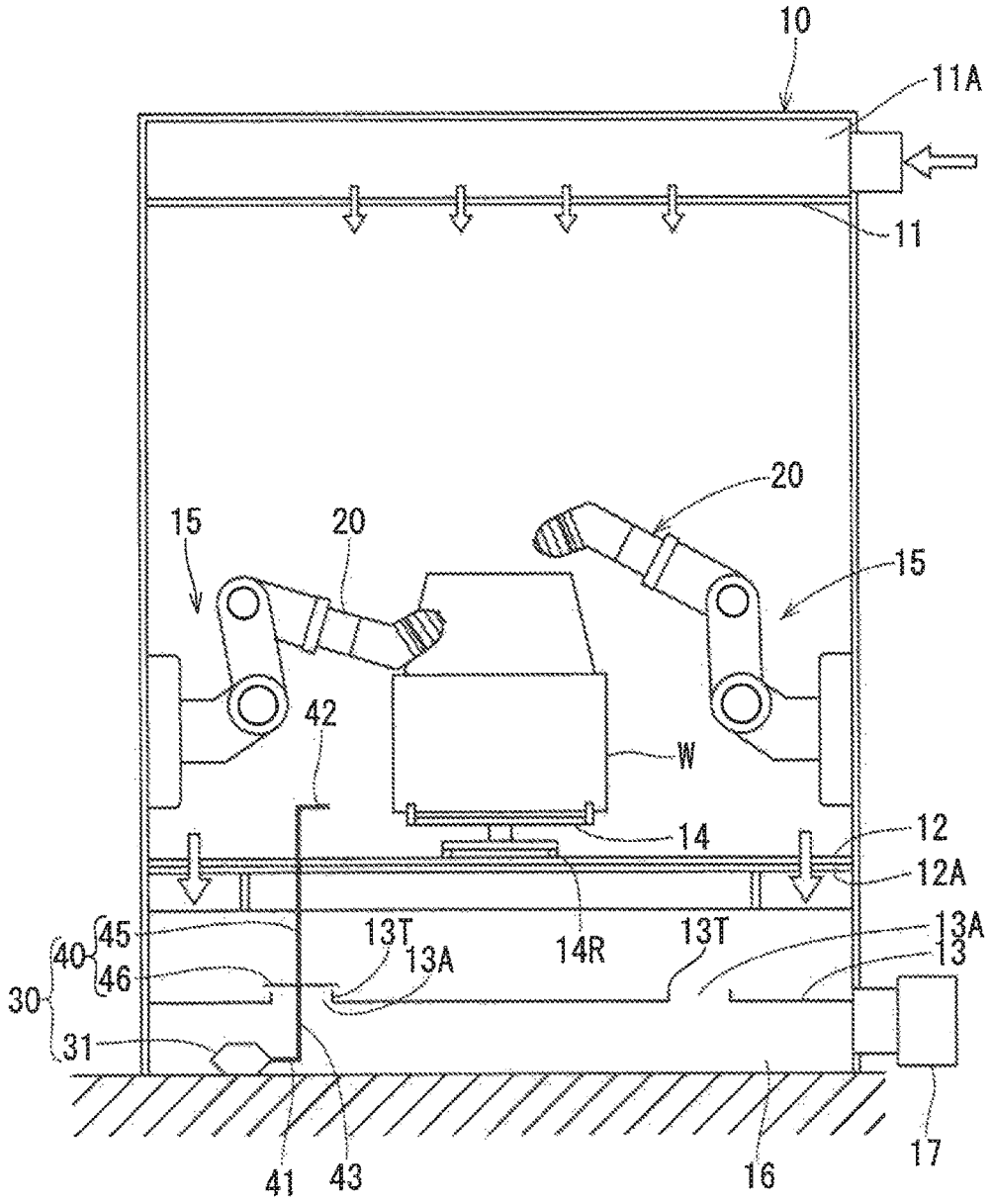
FIG. 3 is a cross-sectional view of a paint booth.

As shown in FIG. 3, the cleaning water feeding tool 40 includes a tool main body 45 and a lid part 46. The tool main body 45 has a structure including, for example, a lower end horizontal portion 41 formed by bending a vertically extending metal pipe at a position close to a lower end at a right angle and an upper end horizontal portion 42 formed by bending the metal pipe at a position close to an upper end at a right angle in an opposite direction to the lower end horizontal part 41. A length of a straight portion 43 extending vertically between the lower end horizontal portion 41 and the upper end horizontal portion 42 is, for example, 1 to 3 (m)

As shown in FIG. 2, the lid part 46 is structured such a manner that a through hole (not shown) is formed at the center of a disk 47 made of a metal, and a cylindrical part 48 is raised from an opening edge of the through hole. The lid part 46 is divided into two at a cutting plane including the centers of the disk 47 and the cylindrical part 48, and flange portions 48F and 48F projecting laterally from the cutting edge of the cylindrical part 48 are superimposed and fixed by bolts B and nuts N. The straight portion 43 of the tool main body 45 is inserted to the inside of the cylindrical portion 48, and by tightening up the bolts B and nuts N described above, the lid part 46 is fixed to an arbitrary position of the straight portion 43.

A tip end at a lower end side of the cleaning water feeding tool 40 (that is, a tip end of the lower end horizontal portion 41) is inserted to the inside of the coupling cylinder part 33D of the water sprinkling cleaning device 31, and in this state, the tapered nut 33N is tightened and the cleaning water feeding tool 40 is fixed to the water sprinkling cleaning device 31. To a tip end at the upper end side of the cleaning water feeding tool 40 at is, a tip end of the upper end horizontal portion 42), a hose 39 made of a soft material is connected via a ball valve 38. Then, cleaning water at a high pressure discharged from a pump (not shown) passes through the hose 39, the ball valve 38, and the cleaning water feeding tool 40 and is supplied to the water sprinkling cleaning device 31.

FIG. 3 shows a paint collecting path 16 (so-called, a booth under section) to be cleaned by the water sprinkling cleaning apparatus 30 described above. This paint collecting path 16 is provided under a floor of a paint booth 10. The paint booth 10 extends in a direction orthogonal to the paper surface of FIG. 3, and at the center in a width direction of a floor portion, a conveyance rail 14R to convey a work W to be painted is provided. Then, the work W to be painted, held on a conveyance carriage 14 that moves on the conveyance rail 14R, is painted with paint mist sprayed from paint guns 20 of paint robots 15 mounted on both side portions of the paint booth 10.

At this time, air is flowed down inside the paint booth 10 and uncoated paint is suctioned together with air to the space under the floor in order to collect uncoated paint. In detail, a ceiling board 11 of the paint booth 10 has a mesh structure, an attic 11A is pressurized, and air is flowed down from the entire ceiling board 11. The floor portion of the paint booth 10 is formed of duckboards 12, and below the duckboards 12, a partition wall 13 (equivalent to the "upper surface wall" of the present invention) that divides the space under the floor into two upper and lower rooms is provided, and a space under the partition wall 13 serves as the paint collecting path 16. In the partition wall 13, a plurality of through holes 13A are formed, and an annular projection 13T projects upward from an opening edge of each through hole 13A. Further, to the paint collecting path 16, a suction duct 17 is connected. In a state where the partition wall 13 is filled with water, the paint collecting path 16 is entirely negatively pressurized, and uncoated paint is taken into the paint collecting path 16 together with air through the through holes 13A, and suctioned in the suction duct 17. A plurality of duckboards 12 are placed on a frame 12A, and are constituted so that a worker can get under the floor by removing arbitrary duckboards 12.

Cleaning of the paint collecting path 16, using the water sprinkling cleaning apparatus 30, is performed as follows. The pressure inside the paint collecting path 16 is set to the atmospheric pressure by stopping a compressor leading to the suction duct 17. The water on the partition wall 13 is removed in advance. Then, a worker gets under the floor by removing predetermined duckboards 12, tilts the cleaning water feeding tool 40 and inserts the water sprinkling cleaning device 31 from the tip end into the through hole 13A of the partition wall 13, and then stand the cleaning water feeding tool 40 uprightly and places the water sprinkling cleaning device 31 on the bottom surface of the paint collecting path 16. In addition, the worker closes the through hole 13A by lowering the lid part 46 along the cleaning water feeding tool 40.

In this state, the worker moves onto the duckboards 12 and supplies cleaning water at a high pressure to the water sprinkling cleaning device 31 by opening the ball valve 38 by operating a lever 38R (refer to FIG. 2) of the ball valve 38. Then, cleaning water jets from the water jet parts 36 of the water sprinkling device 31 and the rotary head 35 rotates in one direction with respect to the rotary base 34, and the rotary base 34 rotates in one direction with respect to the basket-shaped base 32. Accordingly, the cleaning water is sprinkled in all three-dimensional directions and the inside of the paint collecting path 16 is cleaned.

At this time, the cleaning water at a high pressure from the water sprinkling cleaning device 31 collides with the cleaning water feeding tool 40, however, the cleaning water feeding tool 40 is formed of a metal pipe being a hard material, so that the cleaning water feeding tool 40 is prevented from being damaged. In addition, the through hole 13A is closed by the lid part 46, so that the cleaning water is prevented from leaking to the outside through the through hole 13A. Further, the worker can turn the water sprinkling cleaning device 31 by operating the upper end horizontal portion 42 as appropriate. Accordingly, a wide area of the inside of the paint collecting path 16 can be cleaned at a time. After cleaning is finished, the worker closes the ball valve 38 and takes out the water sprinkling cleaning device 31 from the through hole 13A, and performs the same process by inserting the water sprinkling cleaning device 31 into another through hole 13A. Accordingly, the entire inside of the paint collecting path 16 can be cleaned.

As described above, with the cleaning water feeding tool 40, the water sprinkling cleaning apparatus 30, and the method for cleaning the paint collecting path 16 of the present embodiment, a worker can easily clean the paint collecting path 16 without entering the paint collecting path 16. In order to easily move the water sprinkling cleaning device 31 by a turning operation of the upper end horizontal portion 42, a sled extending in a circumferential velocity direction of turning of the water sprinkling cleaning device 31 may be attached to a lower portion of the basket-shaped base 32, or a roller that rolls in a circumferential velocity direction of turning of the water sprinkling cleaning device 31 may be rotatably attached to a lower portion of the basket-shaped base 32.

Second Embodiment

Figure 4:
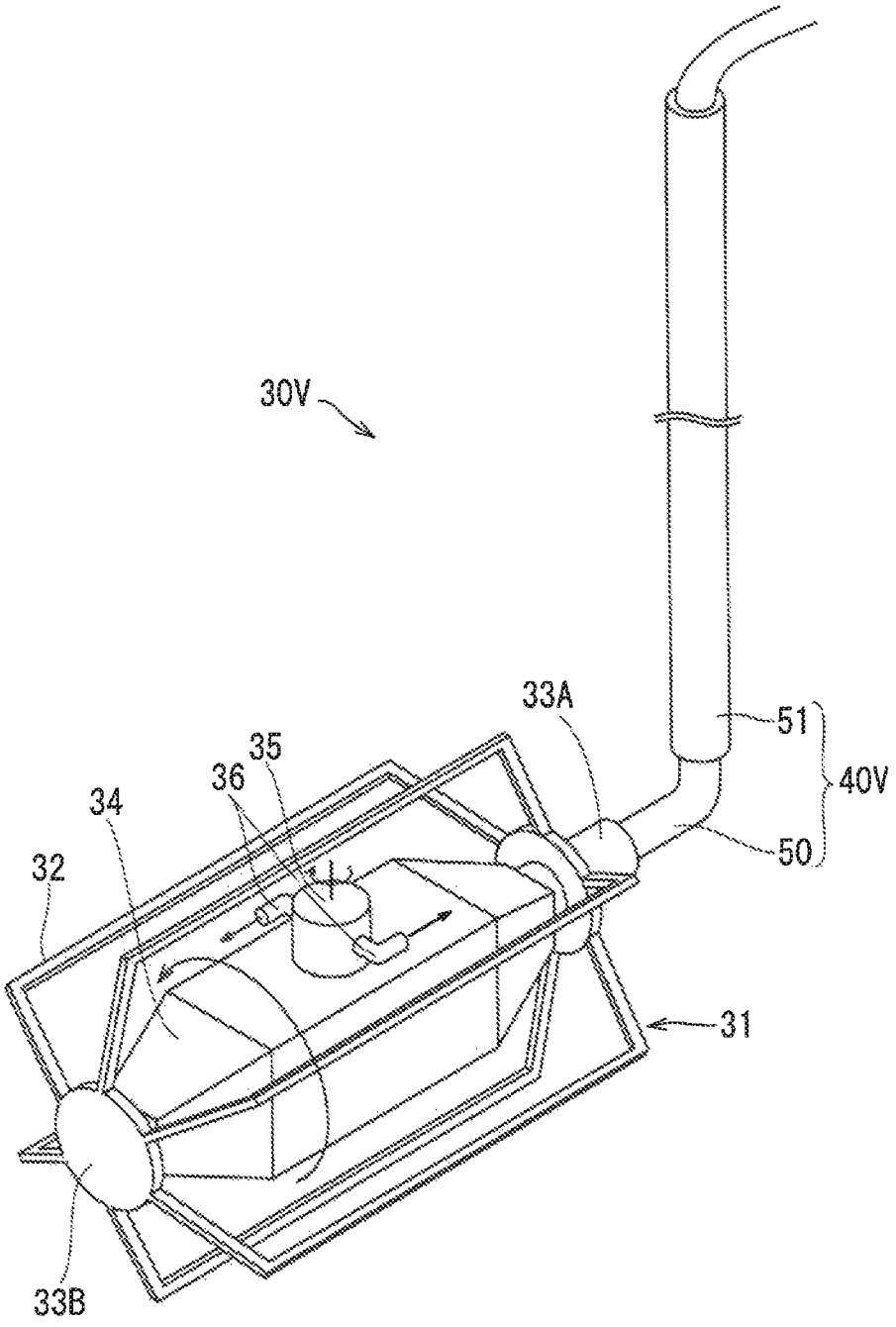
FIG. 4 is a perspective view of a water sprinkling cleaning apparatus according to a second embodiment.

A water sprinkling cleaning apparatus 30V according to the present embodiment is shown in FIG. 4, in which a cleaning water feeding tool 40V is structured by inserting a cover pipe 51 made of a metal onto a hose 50. The hose 50 has a structure in which, for example, meshed reinforcing fibers are embedded in polyester as a soft material, and a tip end portion of the hose 50 is joined to a rotary support part 33A of a water sprinkling cleaning device 31 by a known hose joint structure. Other components are the same as in the first embodiment, so that overlapping description is omitted. In this water sprinkling cleaning apparatus 30V, the water sprinkling cleaning device 31 is disposed coaxially with the cover pipe 51 and can be easily inserted into and extracted from the through hole 13A, so that works of installing and removing the water sprinkling cleaning apparatus 30V can be easily performed.

Third Embodiment

Figure 5:
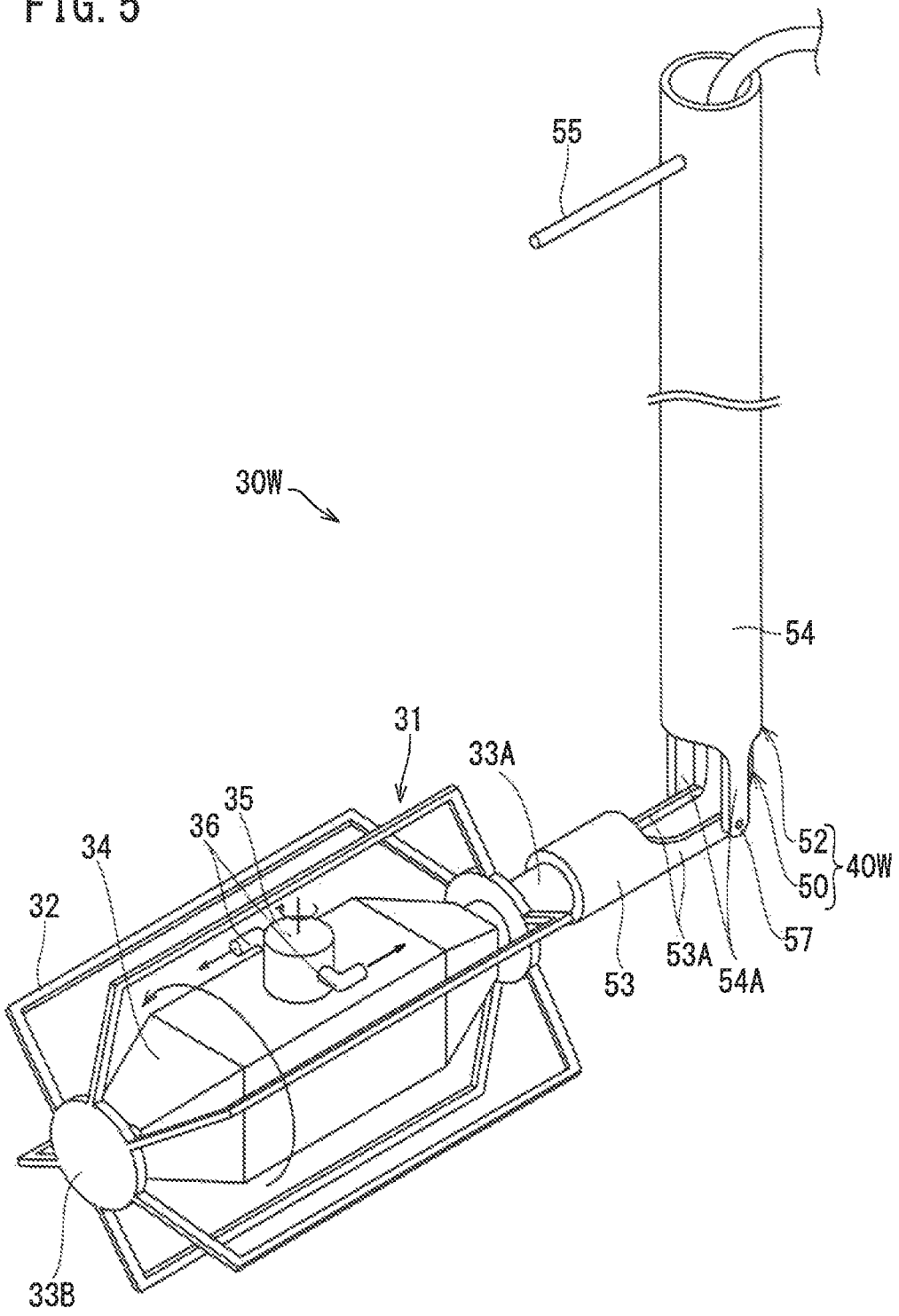
FIG. 5 is a perspective view of a water sprinkling cleaning apparatus according to a third embodiment.

A water sprinkling cleaning apparatus 30W according to the present embodiment is shown in FIG. 5, and a cover pipe 52 of the cleaning water feeding tool 40W is structured by pivotably coupling a first pipe 53 fixed to the water sprinkling cleaning device 31 and extending approximately horizontally and a second pipe 54 extending vertically. In detail, the cover pipe 52 has a structure in which tip end portions of a pair of hinge arms 53A and 53A extended from the first pipe 53 and tip end portions of a pair of hinge arms 54A and 54A extended from the second pipe 54 are joined to each other by hinge pins 57. In the same manner as in the second embodiment, a hose 50, to which the rotary support part 33A of the water sprinkling cleaning device 31 is joined, is inserted inside the cover pipe 52. In addition, a turning operation part 55 projects laterally from an upper end portion of the second pipe 54. With this structure, the water sprinkling cleaning device 31 can be easily taken into and out from a room to be cleaned, and in addition, the water sprinkling cleaning device 31 can be turned from the outside of the paint collecting path 16 by operating the turning operation part 55.

Other embodiments

The present invention is not limited to the embodiments described above, and besides the above, the present invention can be variously changed and carried out without departing from the spirit of the present invention.

(1) The cleaning water feeding tool 40 of the first embodiment described above may also be provided with a turning operation part as in the case of the cleaning water feeding tool 40W of the third embodiment described above.

DESCRIPTION OF THE REFERENCE NUMERAL

10 Paint booth
13 Partition wall (upper surface wall)
13A Through hole
16 Paint collecting path
20 Paint gun
30, 30V, 30W Water sprinkling cleaning apparatus
31 Water sprinkling cleaning device
32 Basket-shaped base
33A, 33B Rotary support part
33C Cleaning water supply port
34 Rotary base
35 Rotary head
36 Water jet part
40, 40V, 40W Cleaning water feeding tool
43 Straight portion
45 Tool main body
46 Lid part
50 Hose
51, 52 Cover pipe
53 First pipe
54 Second pipe
55 Turning operation part

The invention claimed is:

1. A water sprinkling cleaning apparatus comprising:
a water sprinkling cleaning device including:
end portions rotatably supported by a rotary base located between a pair of rotary support parts disposed opposite to each other on a basket-shaped base; and
a water jet part disposed at a side portion of a rotary head projecting from a side surface of the rotary base and rotatably supported such that, when cleaning water is supplied from a cleaning water supply port provided on a rotary support part of the pair of the rotary support parts (i) cleaning water jets from the water jet part, (ii) the rotary head rotates with respect to the rotary base, and (iii) the rotary base rotates with respect to the basket-shaped base; and
a cleaning water feeding tool including:
a hose including:
a horizontal portion having a tip end portion connected to the cleaning water supply port and extending horizontally in a state where a rotary shaft of the rotary base is disposed horizontally, and
a straight portion extending upward from the horizontal portion;
a cover pipe formed of a hard material, which is harder than a material of the hose, and covering at least a portion receiving the cleaning water jetted from the water jet part of the straight portion, the cover pipe including (i) a cylindrically-shaped first pipe fixed to the water sprinkling cleaning device and covering the horizontal portion, and (ii) a cylindrically-shaped second pipe covering the straight portion, the first pipe having a first pair of hinge arms and the second pipe having a second pair of hinge arms rotatably connected to the first pair of hinge arms by hinge pins; and
a turning operation part projecting laterally from an upper end portion of the straight portion, the turning operation part being configured to perform a turning operation of the water sprinkling cleaning device.

2. The water sprinkling cleaning apparatus according to claim 1, further comprising a lid part projecting laterally from the straight portion and closing a through hole formed in an upper surface wall of a room to be cleaned.

3. The water sprinkling cleaning apparatus according to claim 2, wherein the hard material forming the cover pipe is a metal.

4. The water sprinkling cleaning apparatus according to claim 1, wherein the hard material forming the cover pipe is a metal.

5. A method for cleaning a paint collecting path provided under a floor of a paint booth, the paint collecting path being covered at an upper side with an upper surface wall of the paint booth, and uncoated paint is taken together with air within the paint collecting path from a plurality of through holes formed in the upper surface wall, wherein:
the water sprinkling cleaning apparatus according to claim 1 is disposed on a bottom surface of the paint collecting path,
the cleaning water feeding tool is inserted through a through hole of the plurality of through holes, and
cleaning water is supplied to the water sprinkling cleaning device through the cleaning water feeding tool thereby cleaning the paint collecting path.

6. A method for cleaning a paint collecting path provided under a floor of a paint booth, the paint collecting path being covered at an upper side with an upper surface wall of the paint booth, and uncoated paint is taken together with air within the paint collecting path from a plurality of through holes formed in the upper surface wall, wherein:

the water sprinkling cleaning apparatus according to claim 2 is disposed on a bottom surface of the paint collecting path, the cleaning water feeding tool is inserted through a through hole of the plurality of through holes, and cleaning water is supplied to the water sprinkling cleaning device through the cleaning water feeding tool thereby cleaning the paint collecting path.

7. A method for cleaning a paint collecting path provided under a floor of a paint booth, the paint collecting path being covered at an upper side with an upper surface wall of the paint booth, and uncoated paint is taken together with air within the paint collecting path from a plurality of through holes formed in the upper surface wall, wherein:

the water sprinkling cleaning apparatus according to claim 4 is disposed on a bottom surface of the paint collecting path, the cleaning water feeding tool is inserted through a through hole of the plurality of through holes, and cleaning water is supplied to the water sprinkling cleaning device through the cleaning water feeding tool thereby cleaning the paint collecting path.

8. A method for cleaning a paint collecting path provided under a floor of a paint booth, the paint collecting path being covered at an upper side with an upper surface wall of the paint booth, and uncoated paint is taken together with air within the paint collecting path from a plurality of through holes formed in the upper surface wall, wherein:

the water sprinkling cleaning apparatus according to claim 3 is disposed on a bottom surface of the paint collecting path, the cleaning water feeding tool is inserted through a through hole of the plurality of through holes, and cleaning water is supplied to the water sprinkling cleaning device through the cleaning water feeding tool thereby cleaning the paint collecting path.

* * * * *